US006982025B2

(12) United States Patent
Pitt

(10) Patent No.: US 6,982,025 B2
(45) **Date of Patent: *Jan. 3, 2006**

(54) ADJUSTABLE RESILIENT BLADE SUPPORT

(75) Inventor: Richard E. Pitt, Almonte (CA)

(73) Assignee: AstenJohnson, Inc., Charleston, SC (US)

( * ) Notice: Subject to any disclaimer, the term of this patent is extended or adjusted under 35 U.S.C. 154(b) by 19 days.

This patent is subject to a terminal disclaimer.

(21) Appl. No.: 10/450,244

(22) PCT Filed: Dec. 14, 2001

(86) PCT No.: PCT/CA01/01803

§ 371 (c)(1),
(2), (4) Date: Nov. 20, 2003

(87) PCT Pub. No.: WO02/48454

PCT Pub. Date: Jun. 20, 2002

(65) Prior Publication Data

US 2004/0069431 A1 Apr. 15, 2004

(30) Foreign Application Priority Data

Dec. 15, 2000 (GB) ..... 0030679

(51) Int. Cl.
*D21F 1/00* (2006.01)
*D21G 9/00* (2006.01)

(52) U.S. Cl. ..... 162/352; 162/351; 162/374; 162/363; 162/366; 118/413; 15/257.05; 15/256.5

(58) Field of Classification Search ..... 162/352, 162/351, 374, 363, 366; 118/413; 15/256.5, 15/250.4, 257.05
See application file for complete search history.

(56) References Cited

U.S. PATENT DOCUMENTS

| | | | |
|---|---|---|---|
| 4,865,692 | A | 9/1989 | Kade et al. |
| 4,875,977 | A | 10/1989 | Creagan et al. |
| 5,167,770 | A | 12/1992 | Bubik et al. |
| 5,202,000 | A | 4/1993 | Phillips |
| 5,215,628 | A | 6/1993 | Koivuranta et al. |
| 5,262,010 | A | 11/1993 | Bubik et al. |
| 5,354,426 | A | 10/1994 | Rucker |
| 5,427,654 | A | 6/1995 | Gray et al. |
| 5,507,918 | A | 4/1996 | Polifke et al. |
| 5,573,643 | A | 11/1996 | Jaakkola et al. |

FOREIGN PATENT DOCUMENTS

| | | |
|---|---|---|
| CA | 1240187 | 8/1988 |
| CA | 2050647 | 3/1992 |
| DE | 40 28 126 | 3/1992 |
| EP | 0 318 107 | 11/1988 |

(Continued)

*Primary Examiner*—Mark Halpern
(74) *Attorney, Agent, or Firm*—Shapiro Cohen

(57) ABSTRACT

An adjustable resilient blade support for use in the forming section of a papermaking machine. The blade support is adjustable, both to allow the attached blade to be moved from a position where it is out of contact to a position where it is pressed into contact with the adjacent forming fabric, and to permit adjustment of the blade orientation relative to the surface of the forming fabric. The blade support is also resilient, and thus allows the blade to respond to transient localized changes in the path of the forming fabric with which it is in contact. The adjustable resilient blade support of this invention is thus of use in an open surface forming section, and also is of use in forming sections in which two forming fabrics are used.

15 Claims, 2 Drawing Sheets

FOREIGN PATENT DOCUMENTS

Figure 1:
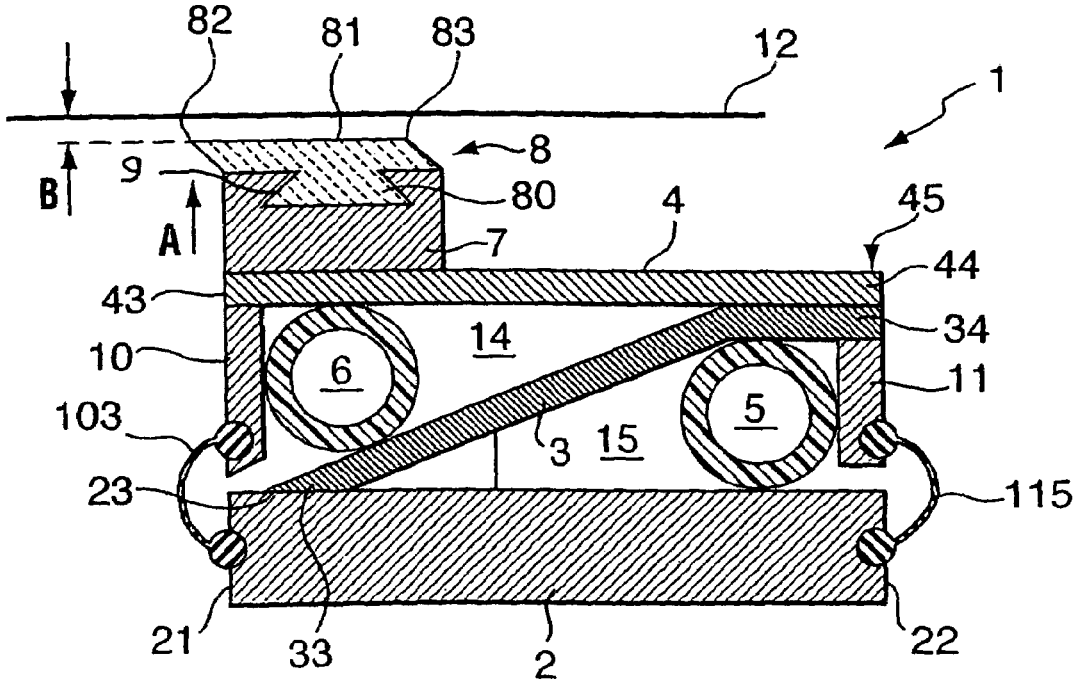

| | | |
|---|---|---|
| EP | 0 373 133 | 11/1989 |
| EP | 0 393 656 | 4/1990 |
| EP | 0 520 970 | 12/1992 |
| EP | 0 900 877 | 3/1999 |
| EP | 1 215 336 A2 | 6/2002 |
| WO | WO 92 04500 | 3/1992 |
| WO | WO 93 12292 | 6/1993 |
| WO | WO 98 44193 | 10/1998 |

ADJUSTABLE RESILIENT BLADE SUPPORT

CROSS-REFERENCE TO RELATED APPLICATIONS

This application is a 371 of PCT/CA01/01803 filed on 14 Dec. 2001.

This application is related to application Ser. No. 10/450,243, assigned to the assignee of this application.

This invention is concerned with an adjustable resilient blade support for use in the forming section of a papermaking machine. The blade support is adjustable, both to allow the attached blade to be moved from a position where it is out of contact to a position where it is pressed into contact with the adjacent forming fabric, and to permit adjustment of the blade orientation relative to the surface of the forming fabric. The blade support is also resilient, and thus allows the blade to respond to transient localised changes in the path of the forming fabric with which it is in contact. The adjustable resilient blade support of this invention is thus of use in an open surface forming section, and also is of use in forming sections in which two forming fabrics are used.

In the forming section of a papermaking machine it is normal practise to remove water passing through the forming fabric by means of a plurality of blades placed in contact with the forming fabric. The blades are located in the cross-machine direction, and are spaced apart in the machine direction. These blades serve a number of purposes, ranging from simply doctoring free liquid off the machine side surface of the forming fabric, to inducing agitation within the stock in an endeavour to improve paper product quality. The prior art is replete with proposed surface contour shapes for these blades, ranging from a simple flat surface with an angled leading edge to doctor off liquid, to complex shapes with cavities, slots and angled trailing edges. The prior art is also replete with proposed structures to support these blades including both rigid and allegedly adjustable constructions.

Although a number of these proposed blade surface contour shapes have found commercial acceptance, most of the adjustable blade mountings have not. The reason appears to be that they are subject to at least three disadvantages. First, they are complex mechanical structures which are often of significant height and are thus difficult to install and to maintain. They also present significant construction difficulties, as modern papermaking machines can be more than 10 meters wide. Second, they nearly all involve mechanisms in which at some point two parts have to move in sliding, or rotating, contact relative to each other. Since it is nearly impossible to prevent fibres from the stock from coating these complex mechanisms, they are prone to jam and thus cannot readily be used to move the attached blade in the Z-direction while the paper making machine is operating. Third, few of the proposed structures permit alteration of the orientation of the blade surface relative to the machine side surface of the forming fabric. Indeed, in some of the proposed adjustable mountings the blade orientation changes as the blade is moved in the Z-direction, thus making it impossible to move the blade without altering its orientation.

This invention seeks to provide an adjustable blade mounting which overcomes these deficiencies. Thus this invention seeks to provide an adjustable blade mounting which does not involve any parts which have to move in sliding, or rotating, contact relative to each other. This invention also seeks to provide an adjustable mounting in which the orientation of the blade relative to the machine side surface of the forming fabric can be controlled over the range of movement permitted by the adjustable blade mounting. Additionally, this invention also seeks to provide a resilient mounting, which allows the blade to respond to transient localised changes in the path of the forming fabric. This capability is of particular relevance to twin fabric forming sections. In the mounting of this invention, blade location in the Z-direction relative to the machine side surface of the forming fabric, and blade surface orientation relative to the machine side surface of the forming fabric, are separately controlled.

Since in the adjustable blade mounting of this invention the blade orientation is independently controlled, the mounting also provides a stable support for the blade which, unlike many known adjustable blade mountings, minimises any rocking movement of the blade as a result of the frictional forces imposed upon it by contact with the machine side surface of the moving forming fabric. Further, since the adjustable blade is moved by fluid pressure, either hydraulic or pneumatic, the adjustable blade mounting allows the blade to bend in the Z-direction in response to localised variations in the path of the machine side surface of the forming fabric with which it is in contact.

In a first broad embodiment, this invention seeks to provide an adjustable resilient blade mounting, for use in the forming section of a paper making machine comprising in combination:

- a base member having a leading face, a trailing face, a first edge and a second edge;
- a first flexible member having a first edge and a second edge, the first edge of the first flexible member being attached to the first edge of the base member;
- a first flexible hose member disposed between the second edges of the base member and the first flexible member;
- a second flexible member having a first edge and a second edge, the second edge of the second flexible member being attached to the second edge of the first flexible member; and
- a second flexible hose member disposed between the first edges of the first and second flexible members.

Preferably, the first edge of the base member is on the leading face of the base member. Alternatively, the first edge of the base member is on the trailing face of the base member.

Preferably, the mounting further includes a first cover disposed adjacent the first hose, and located between the first edges of the first and second flexible members. Preferably, the mounting further includes a second cover disposed adjacent the second hose, and located between the second edges of the base member and the first flexible member. More preferably, the mounting further includes a first cover disposed adjacent the first hose, and located between the first edges of the first and second flexible members, and a second cover plate disposed adjacent the second hose, and located between the second edges of the base member and the first flexible member.

Preferably, the first cover is attached to, or fabricated as part of, the first flexible member. Alternatively, the first member is attached to, or fabricated as part of, the base member.

Preferably, the second cover is attached to, or fabricated as part of, the second flexible member.

Preferably, the base member, the first and second flexible members, and the first and second covers are fabricated as a unitary construction.

In the context of this invention, the following terms have the following meanings.

The term "machine direction" refers to a direction essentially parallel to the direction of movement of the forming fabric.

The term "cross machine direction" refers to a direction essentially perpendicular to the machine direction and essentially parallel to the path of the forming fabric.

The term "Z-direction" refers to a direction essentially perpendicular to both the machine and cross-machine directions.

The term "paper side surface" refers to the surface of the forming fabric upon which the incipient web of paper product is formed, and the associated term "machine side surface" refers to the other side of the forming fabric, which is in contact with the static support blades of the forming section.

The terms "leading edge" and "leading face", each refer to an edge or face towards which the forming fabric travels in the forming section. The associated terms "trailing edge" and "trailing face" each refer to an edge or face which the forming fabric travels away from in the forming section.

The term "localised" when used to refer to changes in the path of a forming fabric embraces changes extending in both the machine direction and the cross machine direction; a localised change in the path of a forming fabric can thus be restricted to only a part of the machine side surface of the fabric.

The invention will now be described with reference to the attached drawings in which:

FIG. 1 shows in cross section a first embodiment of the invention, and

Figure 2:
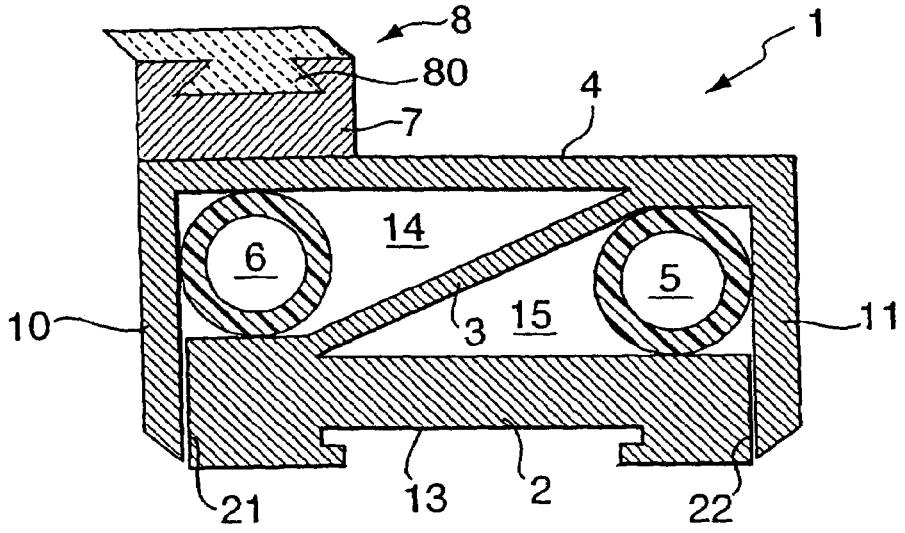
Figure 3:
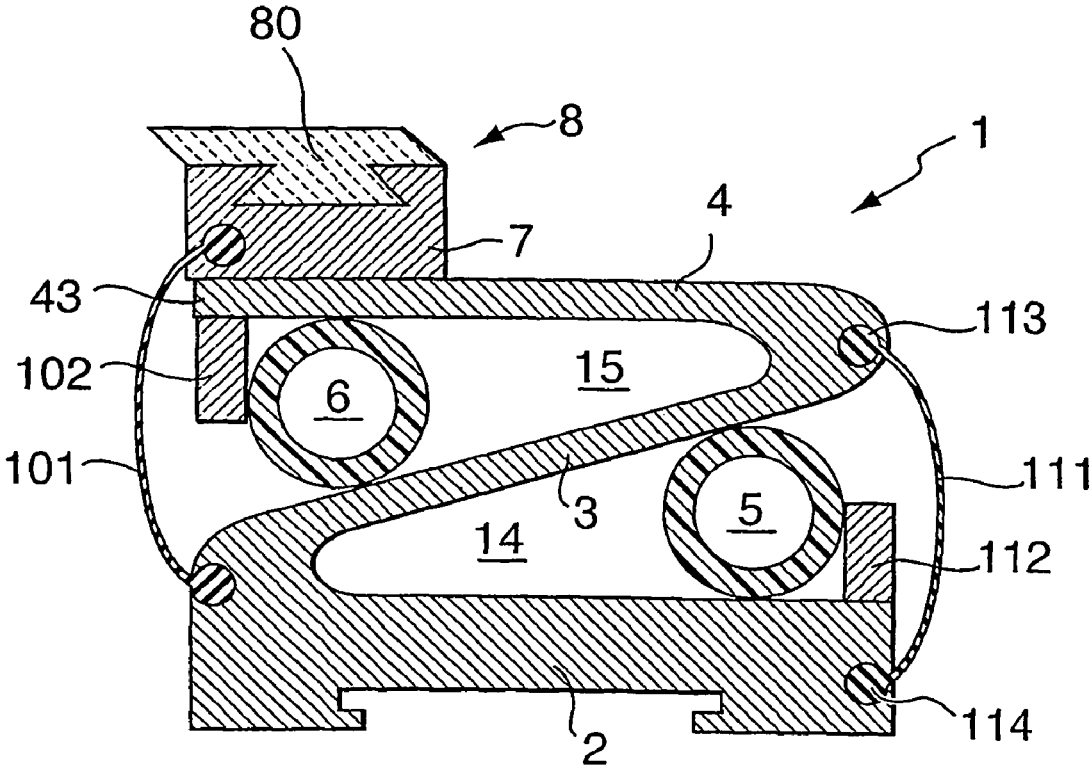

FIGS. 2 and 3 each show cross sections of alternative constructions to that shown in FIG. 1.

Referring first to FIG. 1, the adjustable resilient mounting 1 has a base member 2 which will be attached to a drainage box (not shown) in the papermaking machine forming section in a conventional manner. The base member 2 has a leading face 21 and a trailing face 22. The first flexible member 3 is attached to the base member 2. The first edge 33 of the first flexible member 3 is attached to the first edge 23 of the base member 2; it is shown adjacent the leading edge 21 of the base member 2. The second flexible member 4 is attached at its second edge 44 to the second edge 34 of the first flexible member 3. It can thus be seen that the base member 2 and the two flexible members 3 and 4 together have a more or less Z-shaped cross section. In between the base member 2 and the first flexible member 3 is a first flexible hose 5, and between the first and second flexible members 3 and 4 is a second flexible hose 6. These hoses 5 and 6 are each attached to a conventional controlled pressure source. Each hose is constructed to be flexible enough to expand sufficiently to deflect each of the flexible members; hoses of this general type are known and used. A blade 8 comprising a carrier 7 and a wear resistant material 80 is attached to the second flexible member 4 adjacent its first edge 43. As shown the carrier 7 uses a conventional dovetail 9 to locate the wear resistant material 80; the wear resistant material 80 is commonly a ceramic. As shown the wear resistant material 80 has a flat fabric contacting surface 81; other surface profiles are known and used.

In order to minimise ingress of fluid drained from the stock into the internal spaces 14 and 15 in the mounting, the adjustable resilient blade mounting 1 conveniently also includes a first cover 10 attached to the first edge 43 of the second flexible member 4, and a second cover 11 attached to the second edge 34 of the first member 3. As shown, these covers also assist in locating the hoses 5 and 6.

In FIG. 1 the blade 8 is shown retracted from the adjacent forming fabric 12. In this position the two flexible members 3 and 4 are in their unflexed positions. To move the blade 8 into contact with the forming fabric 12, fluid pressure is applied to the two flexible hoses 5 and 6. The applied pressure flexes the two flexible members 3 and 4, so that the blade 8 moves in the direction shown by the arrow A. The level of applied pressure will determine whether the blade 8 is located in contact with the forming fabric to doctor off surface liquid, or whether it is indented into the path of the forming fabric. The total range of movement provided for the blade 8 will usually be small; a typical range will be from about 0.5 mm to about 10 mm.

In order to expand the two hoses 5 and 6 either hydraulic or pneumatic pressure can be used. Suitable control systems for both pneumatic and hydraulic pressurised systems are well known. A pneumatic system using pressurised air is preferred for installations where mounting resiliency is important.

As shown, the leading edge 82 and the trailing edge 83 of the wear resistant material 80 are both substantially the same distance B from the forming fabric 12, so that the blade 8 is oriented with its surface 81 substantially parallel to the machine side surface of the forming fabric 12. This orientation is readily changed, to move either the leading edge 82 or the trailing edge 83 nearer to the machine side surface of the forming fabric 12, by suitable choices of the pressures used in each of the hoses 5 and 6. The blade 8 is retracted by releasing the pressure in the hoses 5 and 6, which allows the two flexible members to move back to their unflexed positions.

Since the blade 8 is held in contact with the machine side face of the forming fabric 12 by the fluid pressures in each of the hoses 5 and 6, the mounting provides some resiliency, thus allowing the blade 8 to move in response to transient localised changes in the path of the forming fabric 12. This is of particular relevance in a twin fabric forming section, where transient, often localised, variations in the thickness of the stock layer between the two forming fabrics can occur. In an extreme case with a rigidly mounted blade, even if the mounting is adjustable, such transient localised changes can result in damage to the forming fabric in contact with the blade. The resilient mounting of this invention allows the blade to flex locally in the cross machine direction so that at least a portion of it moves essentially in the Z-direction to minimise the risk of damage to the forming fabric.

In FIG. 2 an alternative construction is shown for the adjustable resilient mounting 1. In this construction, the base member 2, the first and second flexible members 3 and 4, and the first and second covers 10 and 11 are all fabricated as a single unitary construction, thus avoiding joints between the various members making up the mounting and the two cover plates. As shown, the covers 10 and 11 also extend over the leading and trailing edges 21 and 22 of the base member 2, for better protection of the internal spaces 14 and 15 from fluid drained from the stock. The base member is also shown to be attached to the drainage box by a conventional T-bar by means of the slot 13.

In FIG. 3 a second alternative construction is shown for the adjustable resilient mounting 1. In this construction, the base member 2 and the two flexible members 3 and 4 are all fabricated as a single unitary construction, thus again avoiding joints between these three members. The blade 8 is attached to the end of the second member 4 at its first edge. In order to prevent ingress of liquid drained from the stock, the internal spaces are sealed by the flexible seals 101 and 111; the two short covers 102 and 112 serve only to assist in retaining the hoses 5 and 6 respectively in place. The seal 111 is held in place by cooperating ribs and slots as at 113 and 114, and the seal 101 is similarly anchored in place; if desired other anchoring means can be used, such as cementing the two seals 101 and 111 in place. It is also desirable that similar flexible seals be used in the constructions shown in FIGS. 1 and 2 between the edges of the covers 10 and 11 and the leading and trailing faces 21 and 22 of the base member 2, as at 103 and 115 in FIG. 1.

In FIGS. 1, 2 and 3 the mounting is shown with the first edges 33 and 43 of the two flexible members 3 and 4 toward the leading edge 21 of the base member. The mounting can be reversed, so that the second edges 34 and 44 of the members 3 and 4 are the same side as the leading edge 21 of the base 2. When the mounting is reversed, the blade 8 is also relocated to the position shown at 45. The leading edge 82 of the blade 8 will always be the same side of the mounting as the leading edge 21 of the base member 2.

The Z-shaped structure of the combination of the base member 2 and the two flexible members 3 and 4 in addition to providing adjustment in the Z-direction and control over the orientation of the blade surface 81 relative to the path of the forming fabric 12 also provides a stable mounting for the blade 8 that is resistant to deflection as a consequence of the frictional forces applied to the blade surface 81 by the moving forming fabric 12.

The adjustable resilient mounting of this invention can be fabricated from a variety of materials, the chief criterion being an ability to withstand the aggressive conditions present in a papermaking machine forming section. When a multi-part construction is used for the adjustable resilient mounting, all of the joints between the two flexible members and the base member, and between the blade carrier 7 and the second flexible member, should be rigidly made, for example by welding, bolting or cementing. Suitable materials of construction for the major parts of the adjustable resilient mounting include metals such as a suitable grade of stainless steel, and fibre reinforced plastic, such as glass fibre reinforced vinyl ester resin. It is preferred to use stainless steel, as this allows better control of the flexibility of the two flexible members. For the two pressure hoses, hoses are available with bellows-like side walls which provide the required expansion capability.

It is also contemplated that more than one adjustable resilient mounting according to this invention can be used within a papermaking machine forming section. In a twin fabric forming section, it is contemplated that the adjustable resilient mounting of this invention can be used on either or both of the machine side surfaces of the two forming fabrics.

What is claimed is:

1. An adjustable resilient blade mounting, for use in the forming section of a paper making machine, comprising in combination:

a base member having a leading face, a trailing face, a first edge and a second edge;

a first flexible member having a first edge and a second edge, the first edge of the first flexible member being attached to the first edge of the base member;

a first flexible hose member disposed between the second edges of the base member and the first flexible member;

a second flexible member having a first edge and a second edge, the second edge of the second flexible member being attached to the second edge of the first flexible member; and a second flexible hose member disposed between the first edges of the first and second flexible members.

2. An adjustable resilient blade mounting according to claim 1 wherein the first edge of the base member is on the leading face of the base member.

3. An adjustable resilient blade mounting according to claim 1 wherein the first edge of the base member is on the trailing face of the base member.

4. An adjustable resilient blade mounting according to claim 1 wherein the mounting further includes a first cover disposed adjacent the second flexible hose member, and located between the first edges of the first and second flexible members.

5. An adjustable resilient blade mounting according to claim 4 wherein the first cover is attached to, or fabricated as part of, the second flexible member.

6. An adjustable resilient blade mounting according to claim 4 wherein a flexible seal is provided between a point adjacent to the second edge of the first flexible member and the base member.

7. An adjustable resilient blade mounting according to claim 4 wherein a flexible seal is provided between a free end of the first cover and the base member.

8. An adjustable resilient blade mounting according to claim 4 wherein a flexible seal is provided between a free end of the second cover and the base member.

9. An adjustable resilient blade mounting according to claim 1 wherein the mounting further includes a second cover disposed adjacent the first flexible hose member, and located between the second edges of the base member and the first flexible member.

10. An adjustable resilient blade mounting according to claim 9 wherein the second cover is attached to, or fabricated as part of, the base member.

11. An adjustable resilient blade mounting according to claim 9 wherein the second cover is attached to, or fabricated as part of, the first flexible member.

12. An adjustable resilient blade mounting according to claim 9 wherein a flexible seal is provided between a point adjacent to the first edge of the second flexible member and the base member.

13. An adjustable resilient blade mounting according to claim 1 wherein the mounting further includes a first cover disposed adjacent the second flexible hose member, and located between the first edges of the first and second flexible members and a second cover disposed adjacent the first flexible hose member, and located between the second edges of the base member and the first flexible member.

14. An adjustable resilient blade mounting according to claim 13 wherein the base member, the first and second flexible members, and the first and second covers are fabricated as a unitary construction.

15. An adjustable resilient blade mounting according to claim 1 wherein the base member and the first and second flexible members are fabricated as a unitary construction.

* * * * *